US008066532B2

(12) United States Patent
Hou et al.

(10) Patent No.: US 8,066,532 B2
(45) Date of Patent: Nov. 29, 2011

(54) ELECTRICAL CONNECTOR ASSEMBLY WITH IMPROVED CONTACT ARRANGEMENT AND METALLIC SHELL

(75) Inventors: Li-Chun Hou, Kunshan (CN); Chin-Te Lai, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/688,926

(22) Filed: Jan. 18, 2010

(65) Prior Publication Data

US 2010/0184329 A1 Jul. 22, 2010

(30) Foreign Application Priority Data

Jan. 18, 2009 (CN) ..... 2009 2 0300284
Mar. 26, 2009 (CN) ..... 2009 2 0301634

(51) Int. Cl.
*H01R 24/00* (2006.01)

(52) U.S. Cl. ..... 439/660

(58) Field of Classification Search ..... 439/660, 439/607.01, 397, 493, 497, 607.05, 607.54
See application file for complete search history.

(56) References Cited

U.S. PATENT DOCUMENTS

| | | | | |
|---|---|---|---|---|
| 6,935,870 | B2 * | 8/2005 | Kato et al. | 439/108 |
| 7,090,534 | B2 | 8/2006 | Wu et al. | |
| 7,267,579 | B1 * | 9/2007 | Wu | 439/607.57 |
| 7,303,410 | B2 * | 12/2007 | Saito | 439/108 |
| 7,462,059 | B2 * | 12/2008 | Saito et al. | 439/397 |
| 7,462,076 | B2 * | 12/2008 | Walter et al. | 439/709 |
| 2004/0058572 | A1 * | 3/2004 | Fromm et al. | 439/101 |

FOREIGN PATENT DOCUMENTS

CN 2711949 Y 7/2005

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector assembly (100) includes an insulative housing (1) with a plurality of terminal passages (12), a plurality of contacts (2) received in the corresponding terminal passages and a PCB (3) electrically connected with the contacts. The PCB has a terminal soldering area (31) and a wire soldering area (32), the terminal soldering area defines a plurality of first conductive pads (311) on a top surface and a bottom surface of the PCB, the first conductive pads are electrically connected with corresponding contacts. The wire soldering area defines a plurality of second conductive pads (321) on the top surface and the bottom surface of the PCB, the second conductive pads are electrically connected with corresponding wires, and the first conductive pads are electrically connected with the second conductive pads, the number of the first conductive pads located on the top surface is different from the second conductive pads on the top surface.

16 Claims, 8 Drawing Sheets

ELECTRICAL CONNECTOR ASSEMBLY WITH IMPROVED CONTACT ARRANGEMENT AND METALLIC SHELL

BACKGROUND OF THE INVENTION

1. Field of the Invention

This application claims priority to prior Chinese patent applications 200920300284.0 and 200920301634.5, the disclosure of which are incorporated herein by reference.

The present invention generally relates to an electrical connector assembly, and more particularly to an electrical connector assembly with improved contact arrangement and metallic shell.

2. Description of Related Art

Developed by Sony, Hitachi, Thomson (RCA), Philips, Matsushita (Panasonic), Toshiba and Silicon Image, the High-Definition Multimedia Interface (HDMI) has emerged as the connection standard for HDTV and the consumer electronics market. HDMI is the first digital interface to combine uncompressed high-definition video, multi-channel audio and intelligent format and command data in a single digital interface. An electrical connector assembly in accordance with HDMI standard can be connected with personal computers, set top box, televisions, etc, and used for audio and video signal transmission via a same cable.

According to HDMI transmitting protocol, a C-type HDMI connector comprises nineteen contacts disposed in a distance of 7.2 millimeter, so the distance of the two neighboring contacts is only 0.4 millimeter, and it's difficult to arrange all the contacts on a same plane. Chinese patent No. 2711949Y published to YangLi on Jul. 20, 2005 discloses an electrical connector assembly compatible with A-type HDMI standard, the electrical connector assembly is defined with contacts thereof arranged on different planes of a PCB, then the distance between the two neighboring contacts can be wider for soldering. A A-type HDMI connector and a C-type HDMI connector have the same number of contacts, and the nineteen contacts comprises three channels transmitting Time Minimized Differential Signal (TMDS) and an individual channel transmitting Time Minimized Differential Signal (TMDS), in order to make sure the uniform time sequence of transmission, each TMDS channel includes a pair of differential signal contacts and a grounding contact. However, in YangLi's invention, the four pairs of differential signal contacts are soldered on two different planes of the PCB, thus the crosstalk therebetween may be increased.

U.S. issued No. 7,090,534B2 published to Wu on Jun. 8, 2006 discloses another HDMI connector, the HDMI connector has a shielding member enclosing a housing and a spacer assembled to the housing, the spacer is exposed beyond the shielding member, but the spacer maybe swing before molding a cover thereon, the connection area between other components maybe unstable, and the connecting area of contacts may be affected by EMI.

Correspondingly, it is desired to have an electrical connector assembly with improved contact arrangement and metallic shell to address the problems stated above.

BRIEF SUMMARY OF THE INVENTION

Accordingly, an object of the present invention is to provide an electrical connector assembly having improved contact arrangement and metallic shell.

In order to achieve the above-mentioned object, an electrical connector assembly in accordance with the present invention comprises an insulative housing with a plurality of terminal passages, a plurality of contacts received in the corresponding terminal passages and a PCB electrically connected with the contacts. The PCB has a terminal soldering area and a wire soldering area, the terminal soldering area defines a plurality of first conductive pads on a top surface and a bottom surface of the PCB, the first conductive pads are electrically connected with corresponding contacts. The wire soldering area defines a plurality of second conductive pads on the top surface and the bottom surface of the PCB, the second conductive pads are electrically connected with corresponding wires, and the first conductive pads are electrically connected with the second conductive pads, the number of the first conductive pads located on the top surface is different from the second conductive pads on the top surface.

Other objects, advantages and novel features of the invention will become more apparent from the following detailed description of the present embodiment when taken in conjunction with the accompanying drawings.

DETAILED DESCRIPTION OF THE INVENTION

Figure 1:
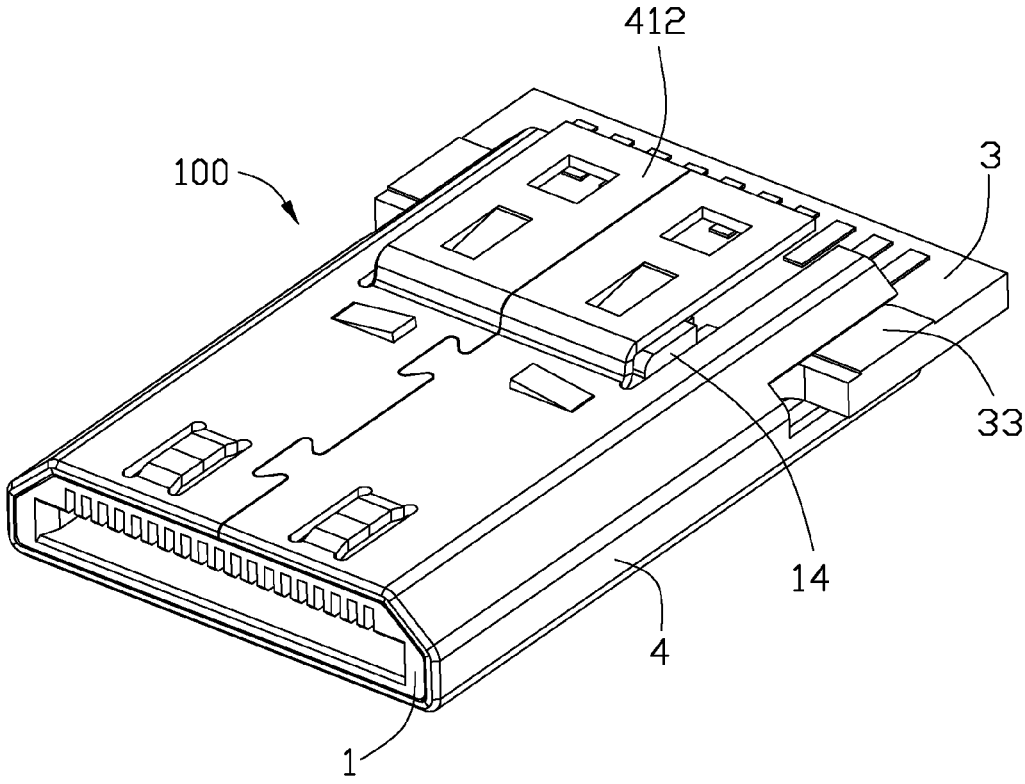
FIG. 1 is an assembled, perspective view of an electrical connector assembly of the present invention.

Reference will now be made to the drawing figures to describe the present invention in detail.

Figure 2:
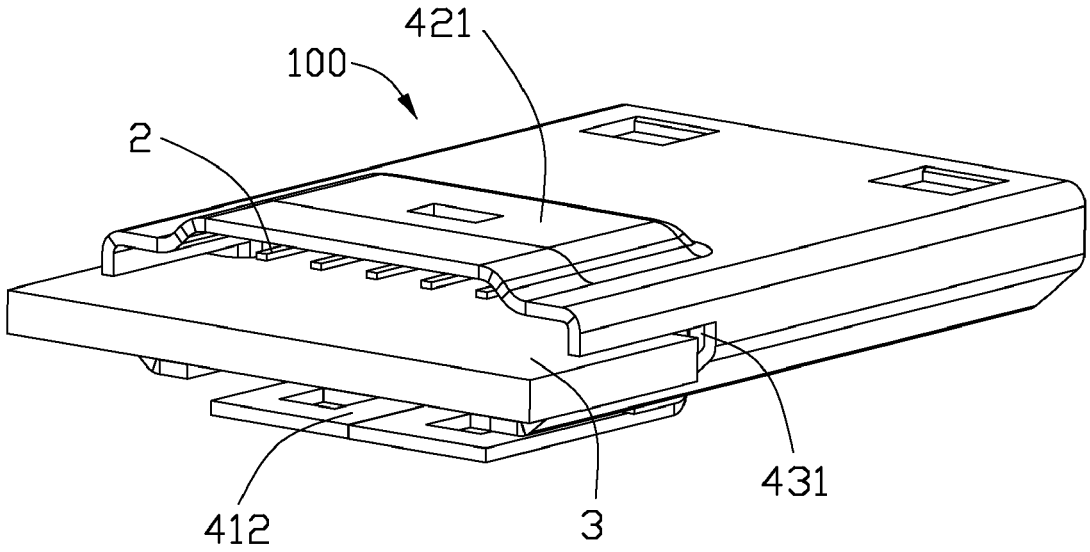
FIG. 2 is similar to FIG. 1, but viewed from another aspect.
Figure 3:
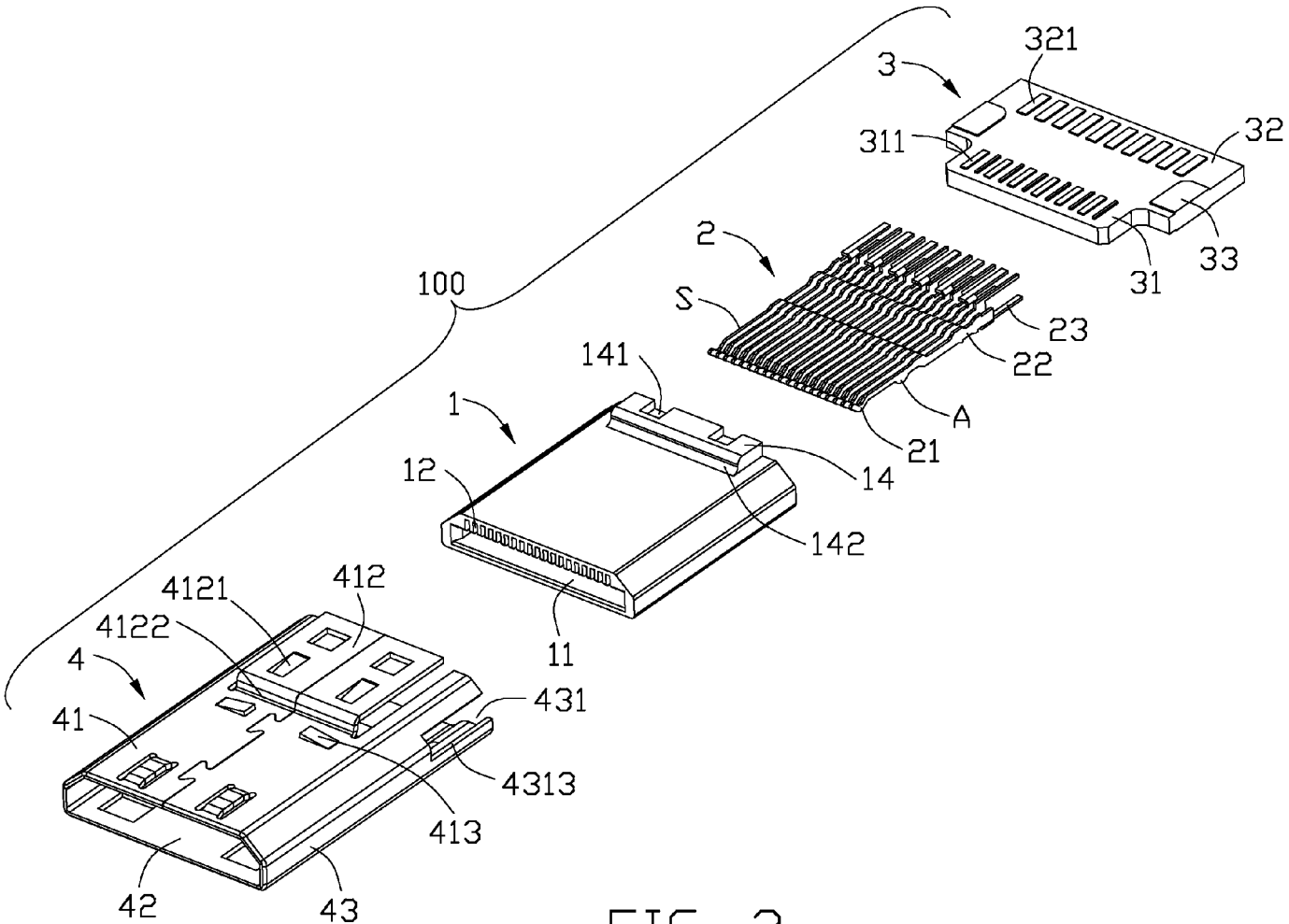
FIG. 3 is an exploded, perspective view of the electrical connector shown in FIG. 1.
Figure 4:
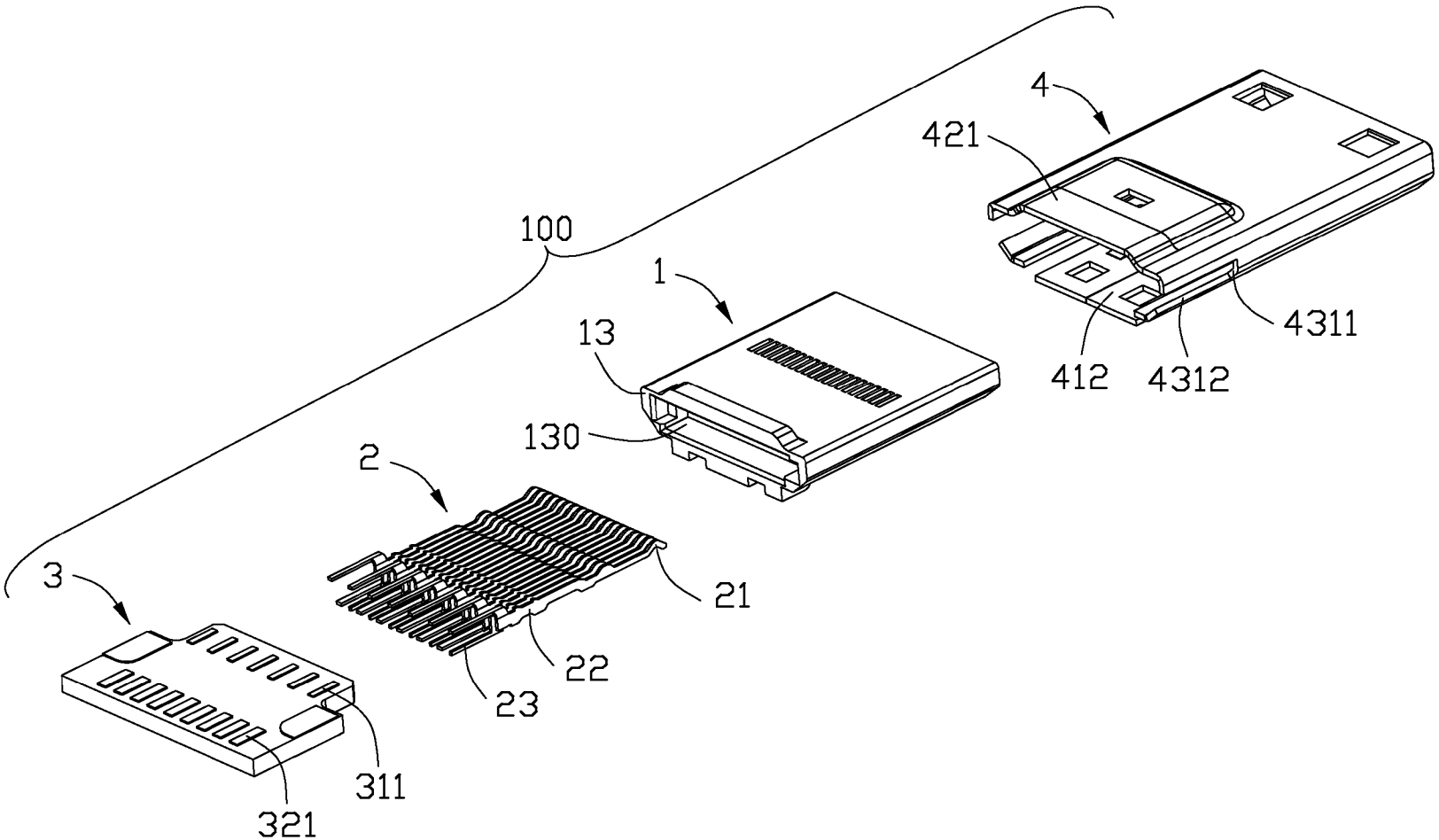
FIG. 4 is similar to FIG. 3, but viewed from another aspect.
Figure 5:
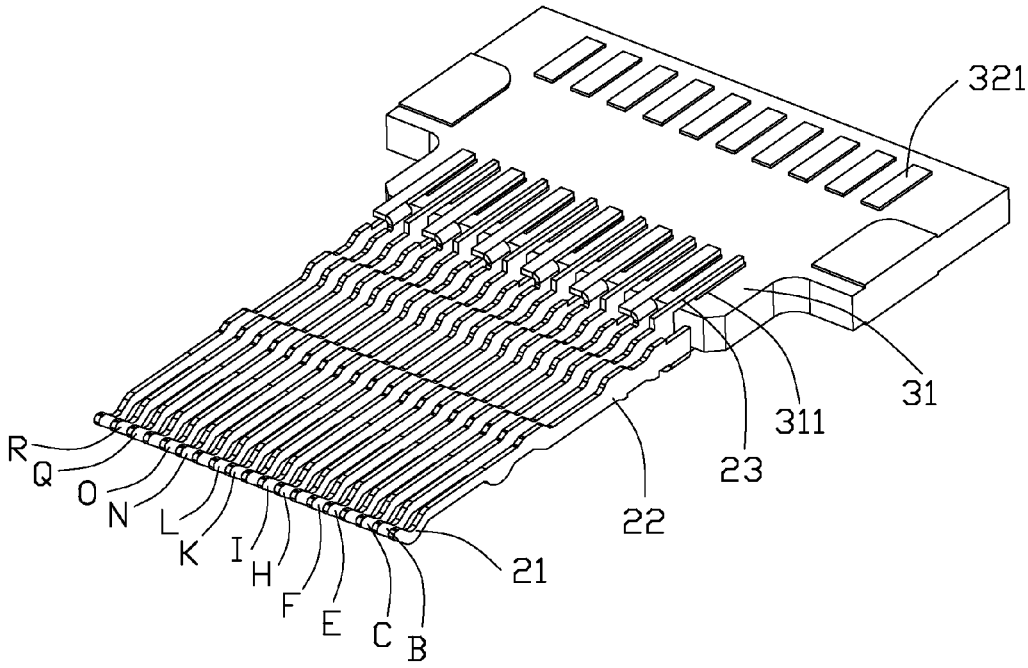
FIG. 5 is a partially assembled view of the electrical connector assembly with contacts connected with a print circuit board.
Figure 6:
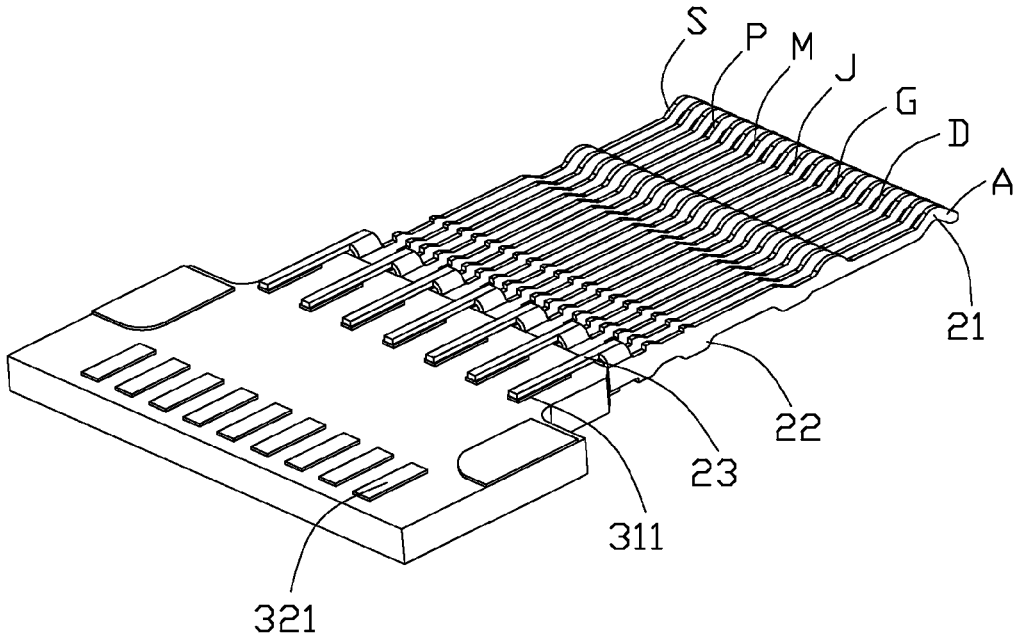
FIG. 6 is similar to FIG. 5, but viewed from another aspect.
Figure 7:
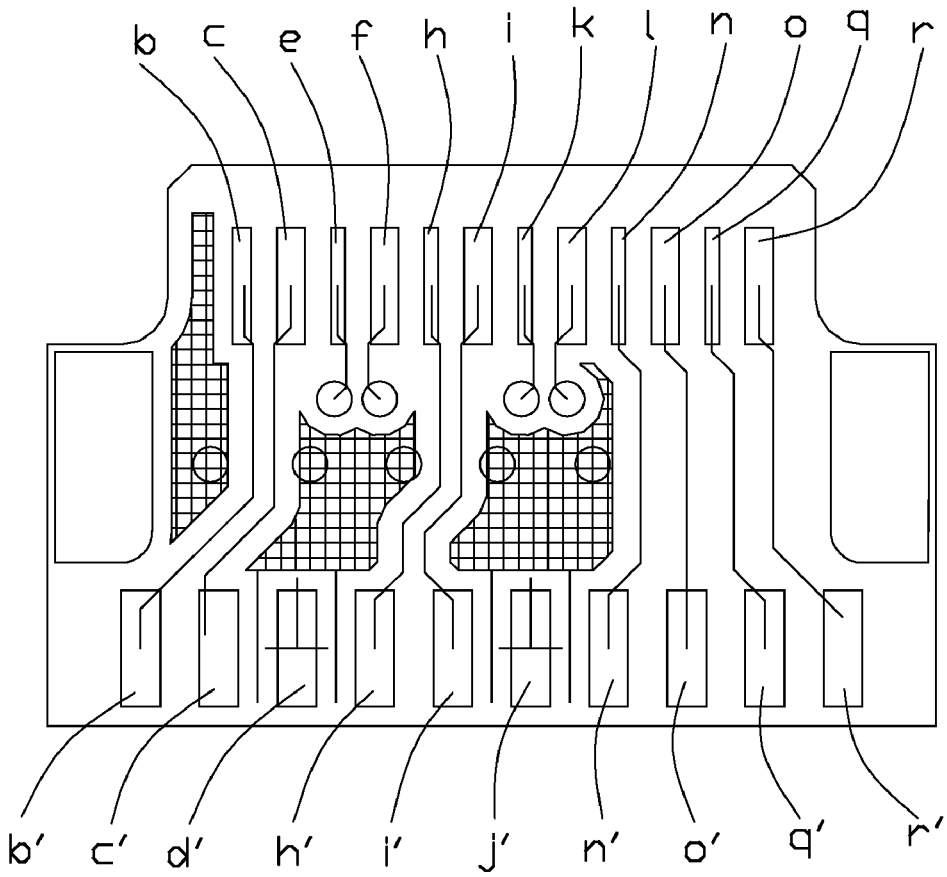
FIG. 7 is a view of a bottom surface of the printed circuit board of the electrical connector assembly.
Figure 8:
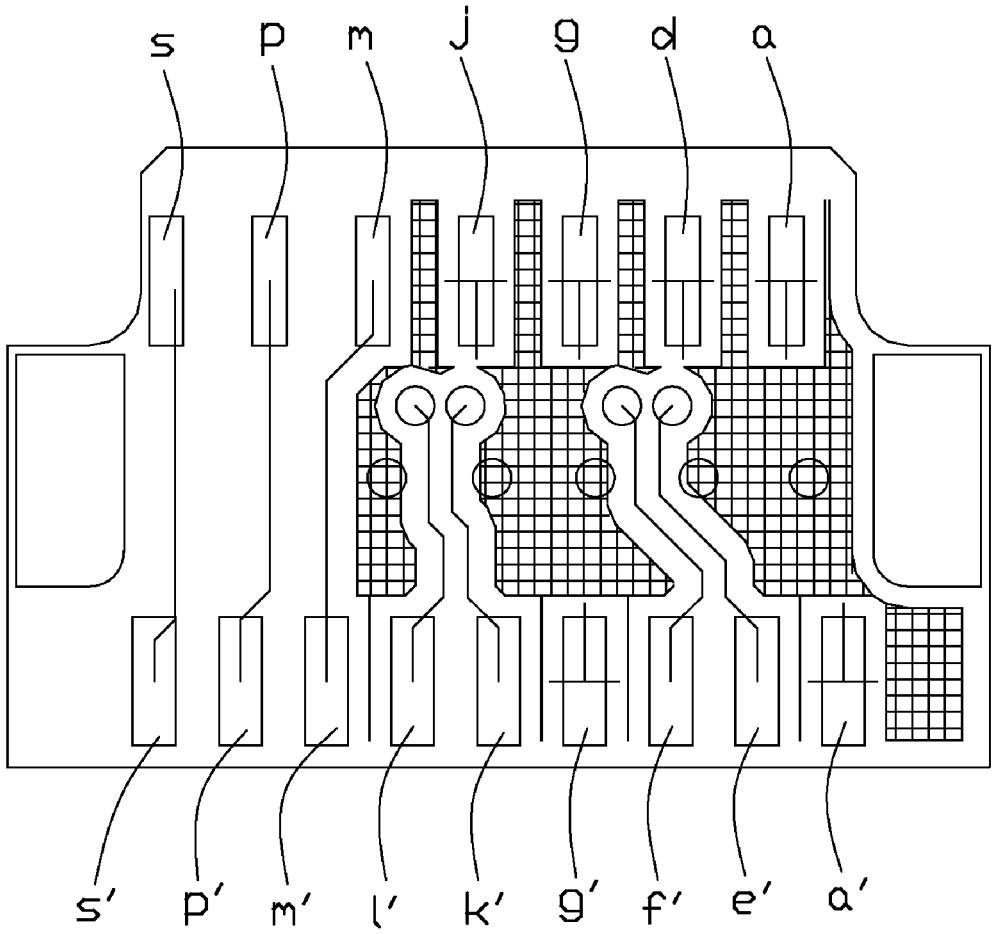
FIG. 8 is a view of a top surface of the printed circuit board.

Referring to FIGS. 1-2, a electrical connector assembly 200 in accordance with the present invention comprises an insulative housing 1, a plurality of contacts 2 received in the insulative housing 1, a printed circuit board (PCB) 3 assembled to the insulative housing 1, a shielding member 4 enclosing the insulative housing 1 and a plurality of wires (not shown) connecting with the PCB 3.

Referring to FIGS. 3-8, the insulative housing 1 comprises a trapezoid space 11 formed by four walls in the front for receiving a complementary connector (not shown), and a plurality of terminal passages 12 formed in upper walls of the insulative housing 1 and communicate with the trapezoid space 11 to receive the contacts 2. A connecting face 13 is defined on a back end of the insulative housing 1, and a cavity 130 is depressed forwards from the connecting face 13. A protrusion 14 is extending upwards from an upper plane of the insulative housing 1, and a rear surface of the protrusion 14 is located on the same plane with the connecting face 13. The protrusion 14 has a pair of slots 141 depressed forwards from the connecting face 13. The protrusion 14 is connected with the upper plane of the insulative housing 1 via a stopping face 142.

The contacts 2 are inserted into the terminal passages 12 from the rear end of the insulative housing 1 along a mating direction, with elastic contact portions 21 in the front of the contacts 2 inserted into the trapezoid space 11 and being capable of mating with complementary contacts, and tail portions 23 exposed beyond the connecting face 13 of the insulative housing 1. A plurality of barbs (not labeled) are formed with retaining portions 22 in the middle of the contacts 2 to hold the contacts 2 in the insulative housing 1. The tail portions 23 of the contacts are divided into two rows to electrically connected with the PCB 3. Additionally, partial tail portions 23 are bent to increase the soldering area, and the rest tail portions are of flat plane shape.

In preferred embodiment of the present invention, the contacts 2 are labeled as A to S, and comprises four pair of differential signal contacts labeled as B, C, E, F, H, I, K, L. Each pair of differential signal contacts is neighboring to a grounding contact, the grounding contacts are labeled as A, D, G, J and located on a first plane with tail portions 23, and the tail portions of the four pair of differential signal contacts are located on a second plane to reduce cross-talk. The tail portions of the seven contacts A, D, G, J, M, P, S are arranged on the first plane, and tail portions of the twelve contacts B, C, E, F, H, I, K, L, N, O, Q, R are arranged on the second plane. The space between the two neighboring tail portions on the first plane is larger than the space between the two neighboring tail portions on the second plane. The tail portions 23 on the first plane are bent to form a curved shape, some of the tail portions 23 on the second plane are bent to form a curved shape and the others are extending to form a flat plate, and the curved tail portions and the flat tail portions are in stagger relationship with each other.

The PCB 3 has a plurality of conductive pads on an upper and a lower surface thereof, a narrower segment in the front of the PCB 3 is defined with a terminal soldering area 31, and a wider segment in the back of the PCB 3 is defined with a wire soldering area 32. The terminal soldering area 31 has a plurality of first conductive pads 311 thereon, and the wire soldering area 32 has a plurality of second conductive pads 321. A pair of conjunction parts 33 with conductive pads are defined on both sides of the wire soldering area 32. The PCB 3 has a terminal soldering area 31 on a top surface and another terminal soldering area 31 on a bottom surface thereof. The pair of conjunction parts 33 are arranged on both of the top surface and the bottom surface in preferred embodiment of the present invention, and in other embodiment of the present invention, the pair of the conjunction parts 33 can be defined on one of the top surface and the bottom surface.

The first conductive pads 311 on the top surface of the PCB 3 are corresponding to the tail portions 23 on the first plane and labeled as a, d, g, j, m, p, s. The first conductive pads 311 on the bottom surface of the PCB 3 are corresponding to the tail portions 23 on the second plane and labeled as b, c, e, f, h, I, k, l, n, o, q, r, and the two neighboring first conductive pads 311 on the bottom surface have different soldering areas with each other. The space between the two neighboring first conductive pads 311 on the top surface is lager than the space between the two neighboring on the bottom surface. In order to be soldered with the wires conveniently, the second conductive pads 321 are divided into two groups located on the top surface and the bottom surface respectively, and the space between the two neighboring second conductive pads 321 is defined equally. The nine second conductive pads 321 on the top surface are labeled as a', e', f', g', k', 1', m', p', s', and the ten second conductive pads 321 on the bottom surface are labeled as b', c', d', h', i', j', n', o', q', r'. The contacts labeled as A to S are soldered to the first conductive pads labeled as a to s in one-to-one manner, the first conductive pads 311 are connected with the second conductive pads 321 via conductive traces, the first conductive pads a, g, m, p, s on the top surface are connected with the second conductive pads a', g', m', p', s' on the top surface by conductive traces, the first conductive pads d, j on the top surface are connected with the second conductive pads d', j' on the bottom surface by another conductive traces, the first conductive pads b, c, h, i, n, o, q, r on the bottom surface are connected with the second conductive pads b', c', h', i', n', o', q', r' on the bottom surface by conductive traces, the first conductive pads e, f, k, 1 on the bottom surface are connected with the second conductive pads e', f', k', 1' on the top surface by conductive traces, thus to realize the contacts electrically connecting with the second conductive pads.

The shielding member 4 is of frame-shape and comprises a top wall 41, a bottom wall 42 and a pair of side walls 43 connected with the top wall 41 and the bottom wall 42. The top wall 41 defines a shelter 412 bent upwards and separated partially from thereof, a pair of locking tabs 4121 are formed in the front of the shelter 412, and rear ends of the locking tabs 4121 are linking with the shelter 412 with front ends of the locking tabs 4121 bent downwards. A pair of projections 413 are arranged on the top wall 41 and neighboring to the shelter 412, when molded a cover (not shown), melted material of the cover is combined with the projections 413 to enhance the intensity of the conjunction between the shielding member 4 and the cover. Each side wall 43 defines a cutout 431 depressed forwards from a back end thereof, and each cutout 431 has an inner wall 4311 on the front side, an upper wall 4312 and a lower wall 4313 opposite to the upper wall 4312. The inner wall 4311 is located behind a linking portion 4122 connecting the shelter 412 and the top wall 41 along the mating direction. The bottom wall 42 is depressed to form a sunken 421 increasing the accommodating space, and the sunken 421 is opposite to the shelter 412.

Referring to FIGS. 1-4, in assembly, the contacts 2 are inserted into the terminal passages 12 of the insulative housing 1 from back-to-front, and the contacting portions 21 are exposed in the trapezoid space 11 of the insulative housing 1. The PCB 3 is assembled to the insulative housing 1 along the rear-to-front direction, and tail portions 23 of the contacts 2 are arranged in two rows to connect with the first conductive pads 311 on the top surface and the bottom surface respectively. The terminal soldering areas 31 are accommodated in the cavity 130 of the insulative housing 1 with front parts. The tail portions 23 of the contacts 2 are soldered to the corresponding first conductive pads 311, the wires are soldered to the corresponding second conductive pads 321. Then the shielding member 4 is assembled to the insulative housing 1 with front part thereof enclosing the insulative housing 1, the shelter 412 and the sunken 421 are extending beyond the connecting face 13 and located on out side of the PCB 3 for shielding the connection area to prevent EMI. The locking tabs 4121 of the shielding member 4 are latched in the slots 141 of the insulative housing 1 to prevent the movement between the shielding member 4 and the insulative housing 1. The linking portion 4122 of the shielding member 4 is adjacent to the stopping face 142 of the protrusion 14 to prevent the shielding member 4 moving rearwards. The wire soldering areas 32 of the PCB 3 are inserted into the cutouts 431, with the conjunction parts 33 soldered with the upper walls 4312 and the lower walls 4313 to prevent the PCB 3 swinging. After that, the cover is over-molded on the shielding member 4.

The tail portions 23 of the contacts 2 are arranged into two rows soldered on the top surface and the bottom surface of the PCB 3 respectively, and tail portions 23 of the four pairs of differential signal contacts are defined on the same plane to reduce cross-talk in signal transmission. The second conductive pads 321 are disposed on both of the top surface and bottom surface of the PCB 3 to make the space between the two neighboring larger for soldering.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an insulative housing with a plurality of terminal passages;

a plurality of contacts received in the corresponding terminal passages, each contact including a contact portion, a retaining portion and a tail portion, tail portions of the contacts arranged into two rows, tail portions of all pairs of differential signal contacts located on a same row, the contact portions of the contacts aligned on a line; and a PCB electrically connected with the contacts, and having a terminal soldering area and a wire soldering area, the terminal soldering area defining a plurality of first conductive pads on a top surface and a bottom surface of the PCB, the first conductive pads electrically connected with corresponding contacts, and the wire soldering area defining a plurality of second conductive pads on the top surface and the bottom surface of the PCB, the second conductive pads electrically connected with corresponding wires, and the first conductive pads electrically connected with the second conductive pads, the number of the first conductive pads located on the top surface different from that of the second conductive pads on the top surface, wherein the first conductive pads are defined on a narrower segment of the PCB, and the second conductive pads are defined on a wider segment of the PCB, the space between the two neighboring first conductive pads on the top surface of the PCB is different from the space between the two neighboring second conductive pads on the top surface of the PCB, the tail portions of the contacts including two types, one type of tail portion is flat, and the other type is curved, the curved tail portions have larger soldering areas than the flat ones.

2. The electrical connector assembly as claimed in claim 1, wherein the curved tail portions and the flat tail portions in a top row are in stagger relationship.

3. The electrical connector assembly as claimed in claim 2, wherein the first conductive pads connecting with the tail portions in the top row have different soldering area with each other, and the first conductive pad on the top surface of the PCB having a smaller soldering area is sandwiched between the two closer first conductive pads having larger soldering areas.

4. The electrical connector assembly as claimed in claim 3, wherein some of the first conductive pads of the PCB are electrically connected with the second conductive pads on the same surface of the PCB by conductive traces.

5. The electrical connector assembly as claimed in claim 4, wherein another first conductive pads are electrically connected with the second conductive pads on different surfaces of the PCB by conductive traces.

6. The electrical connector assembly as claimed in claim 5, further comprising a shielding member, the insulative housing is enclosed in the shielding member, a pair of conjunction parts are defined on both sides of the PCB and soldered with the shielding member.

7. An electrical connector assembly, comprising:

an insulative housing having a plurality of terminal passages and a connecting face on a rear end;

a plurality of contacts received in the corresponding terminal passages;

a PCB electrically connected with the contacts; and a shielding member enclosing the insulative housing and having a top wall, a bottom wall and a pair of side walls, the top wall and the bottom wall extending beyond the connecting face of the insulative housing and shielding on outer sides of the PCB, each side wall defining a cutout receiving and soldering with lateral sides of the PCB.

8. The electrical connector assembly as claimed in claim 7, wherein the top wall defines a shelter bent upwards, and the shelter is separated from the top wall with a rear end.

9. The electrical connector assembly as claimed in claim 7, wherein a sunken is depressed in the bottom wall and opposite to the shelter.

10. The electrical connector assembly as claimed in claim 9, wherein the shelter has a pair of locking tabs latched in a pair of slots defined on a protrusion of the insulativwe housing.

11. The electrical connector assembly as claimed in claim 10, wherein the top wall is connecting with the shelter via a linking portion, and the linking portion is adjacent to a stopping face of the protrusion.

12. An electrical connector assembly comprising:

an insulative housing defining a mating port;

one row of contacts spreading in a transverse direction while each of the contacts extending along a front-to-back direction perpendicular to said transverse direction, under condition that having all corresponding contact sections of said contacts are disposed by only one of opposite upper and lower sides of the mating port in one row while all corresponding soldering tails of said contacts are arranged in upper and two rows;

the contacts including a plurality of grounding contacts and a plurality of differential pairs alternately arranged with one another along a transverse direction so as to have the corresponding contacting sections arranged same format while having the corresponding soldering tails arranged in two rows, of which in one row the plurality of differential pairs are continuously arranged one pair by one pair in said transverse direction, and in the other row the plurality of grounding contacts are continuously arranged one by one in said transverse direction; and a printed circuit board located behind the housing and defining a plurality of first and second conductive pads respectively formed on front portions of opposite first and second surfaces of the printed circuit board; wherein the soldering tails of the differential pairs are mounted to the corresponding first conductive pads on the first surface, and the soldering tails of the grounding contacts are mounted to the corresponding second conductive pads on the second surface.

13. The electrical connector assembly as claimed in claim 12, wherein a plurality of third and fourth conductive pads respectively are formed on rear portions of the opposite first and second surfaces of the printed circuit board, respectively, under condition that the third conductive pads on the first surface are alternately electrically connected, via conductive traces, to some of said first conductive pads and some of said second conducive pads alternately, and the fourth conductive pads on the second surface are electrically connected, via conductive traces, to others of said second conductive pads and others of said first conductive pads alternately.

14. The electrical connector assembly as claimed in claim 12, wherein a gap between every adjacent two first pads is constant and similar to a distance between every adjacent two contacts while being smaller than a pitch between every adjacent two first pads.

15. The electrical connector assembly as claimed in 14, wherein in each differential pair, the soldering tail of one is straight for soldering to the corresponding small first conductive pad while that of the other is bent for soldering to the corresponding large conductive pad.

16. The electrical connector assembly as claimed in claim 12 wherein the tails of the grounding contacts are curved transversely toward the corresponding tails of the differential pairs, respectively.

* * * * *